US005746225A

United States Patent [19]

Okumoto et al.

[11] Patent Number: 5,746,225

[45] Date of Patent: May 5, 1998

[54] METHOD AND APPARATUS FOR DETERMINING THE TOBACCO SHRED FILLING QUALITY OF CIGARETTE RODS

[75] Inventors: Yutaka Okumoto; Shigemitsu Inomata, both of Tokyo, Japan

[73] Assignee: Japan Tobacco Inc., Tokyo, Japan

[21] Appl. No.: 816,367

[22] Filed: Mar. 14, 1997

[30] Foreign Application Priority Data

Mar. 14, 1996 [JP] Japan ..... 8-057283

[51] Int. Cl.[6] ..... A24C 5/14

[52] U.S. Cl. ..... 131/84.1; 131/84.2; 131/94; 131/281

[58] Field of Search ..... 131/84.1, 84.2, 131/84.3, 84.4, 281, 94, 905, 906, 108

[56] References Cited

U.S. PATENT DOCUMENTS

| | | | |
|---|---|---|---|
| 3,056,026 | 9/1962 | Bigelow | 131/84.1 |
| 4,326,542 | 4/1982 | Laszlo et al. | 131/280 |
| 4,785,830 | 11/1988 | Moller et al. | 131/84.1 |
| 4,865,052 | 9/1989 | Hartman et al. | 131/844 |
| 5,141,001 | 8/1992 | Heitmann | 131/84.1 |
| 5,329,945 | 7/1994 | Irikura et al. | 131/94 |

*Primary Examiner*—Vincent Millin
*Assistant Examiner*—Charles W. Anderson
*Attorney, Agent, or Firm*—Birch, Stewart, Kolasch & Birch, LLP

[57] ABSTRACT

An apparatus for determining a tobacco shred filling quality includes a rotational position detector for detecting the rotational position of a driving drum of a cigarette manufacturing apparatus, a density detector for continuously detecting a tobacco shred filling density of a continuous cigarette rod, and a controller which receives the outputs of both detectors. The controller samples a density signal from the density detector every time it receives a pulse signal from the rotational position detector during a period corresponding to a distance from the beginning of the rear end portion of each double cigarette rod to the end of the front end portion of a succeeding double cigarette rod, and integrates the sampled density signal over a period corresponding to each end portion of each double cigarette rod. When the integration result falls below an allowable lower limit, the controller determines that tobacco shreds are likely to fall from the ends of the double cigarette rod during the manufacturing process, and eliminates this double cigarette rod when it reaches a filter attachment section.

12 Claims, 8 Drawing Sheets

METHOD AND APPARATUS FOR DETERMINING THE TOBACCO SHRED FILLING QUALITY OF CIGARETTE RODS

BACKGROUND OF THE INVENTION

1. Field of the Invention

The present invention relates to a method and apparatus for manufacturing cigarettes from a continuous cigarette rod obtained by wrapping tobacco shreds with a cigarette paper. More particularly, this invention relates to a method and apparatus for determining the tobacco shred filling quality of cigarette rods, which predict a possibility that tobacco shreds come off from one or both of the ends of cigarette rods obtained by cutting a continuous cigarette rod.

2. Related Art

In the typical way of manufacturing filter cigarettes, tobacco shreds are wrapped with an elongated cigarette paper to acquire a long continuous cigarette rod, then the continuous cigarette rod is cut into cigarette rods of double unit length, and then each cigarette rod of double unit length is cut to two cigarette rods of single unit length. Each pair of cigarette rods are separated from each other, a filter plug of double unit length is inserted between both cigarette rods, those two cigarette rods and the filter plug are connected together by a tipping paper, and the resultant rod structure is cut at the center of the filter plug to yield filter cigarette rods.

According to the above-described cigarette manufacturing process, during cutting of a continuous cigarette rod, during attachment of each filter plug or during conveyance of cigarette rods, tobacco shreds may come off from one or both of the ends of the cigarettes due to some cause like some kind of shock applied to the cigarette rods and the resultant cigarette rods may become defective. One way to reduce the probability of occurrence of such defects is to make the tobacco shred filling amount near the end of each cigarette rod greater than the tobacco shred filling amount at the other portion. Even such a countermeasure is taken, however, insufficient filling of tobacco shreds occurs due to some kind of shock applied to the cigarette rods, a variation in the supply amount of tobacco shreds during manufacture or the like and which leads to the falling of tobacco shreds from one or both of the ends of cigarette rods.

Conventionally, after a continuous cigarette rod is cut into cigarette rods, the tobacco shred filling states at the end portions of the individual cigarette rods are detected on the end face side of the cigarette rods by a photosensor or a capacitance proximity sensor, and it is determined based on the detection results whether or not tobacco shreds have fallen.

However, there are a variety of tobacco shred filling states (depths and densities) at cigarette ends. What is more, the positions and postures of cigarette rods when passing near the sensor vary from one cigarette rod from another, so that it is difficult to always ensure a fixed positional relationship between the end faces of the individual cigarette rods and the sensor. Therefore, in the prior art, there involves a difficulty in setting the reference for determining the tobacco shred filling quality, and erroneous determination is liable to occur. In other words, while relaxing the reference for determination leads to escape of defects, establishing a severe reference for determination results in an erroneous determination of good cigarettes as defects.

SUMMARY OF THE INVENTION

Accordingly, an object of the present invention is to provide a method and apparatus for determining the tobacco shred filling quality of cigarette rods, which precisely determine a possibility that tobacco shreds come off from one or both of the ends of cigarette rods.

Another object of this invention is to provide a method and apparatus for determining the tobacco shred filling quality of cigarette rods, which eliminate defective cigarette rods whose tobacco shreds are likely to come off.

According to one aspect of this invention, there is provided a method of determining the tobacco shred filling quality of cigarette rods acquired by cutting a continuous cigarette rod obtained by wrapping tobacco shreds with a cigarette paper.

This method comprises a detection step of sequentially detecting tobacco shred filling states in those predetermined portions of the continuous cigarette rod which correspond to at least respective one end portions of individual cigarette rods before cutting the continuous cigarette rod; and a prediction step of sequentially predicting tobacco shred filling qualities at at least respective one end portions of individual cigarette rods, based on the sequentially detected tobacco shred filling states, before the continuous cigarette rod is cut into the individual cigarette rods.

The method of this invention has the following advantage. As tobacco shred filling states in the predetermined portions of the continuous cigarette rod are sequentially detected before the continuous cigarette rod is cut into cigarette rods, the factor of reducing the detection precision in the prior art (a variation in the positional relationship between the sensor and cigarette rods) can be eliminated, and the tobacco shred filling states in one end portions or both end portions of individual cigarette rods can be precisely predicted based on the tobacco shred filling states in the predetermined portions of the continuous cigarette rod that have been detected with a high accuracy. It is therefore possible to reliably predict a possibility that tobacco shreds come off from one or both of the ends of the individual cigarette rods.

Preferably, the method of this invention further comprises an elimination step of eliminating those cigarette rods whose tobacco shred filling states have been predicted as improper in the prediction step after those cigarette rods are cut out from the continuous cigarette rod.

According to this preferable mode, those cigarette rods which have been predicted as "having a possibility of their tobacco shreds falling from one or both of the cigarette ends" can be rejected in advance, thus improving the quality of produced cigarettes.

The method of this invention is preferably adapted for cigarette production which make tobacco shred filling densities at the predetermined portions of the continuous cigarette rod higher than those at other portions of the continuous cigarette rod.

According to this preferable mode, it is possible to reliably predict a possibility of the falling of tobacco shreds from one or both of the ends of cigarette rods which can still occur even if the tobacco shred filling densities in one end portions or both end portions of individual cigarette rods are increased.

To manufacture filter cigarettes, the continuous cigarette rod may be cut into first cigarette rods of double unit length, then each of the first cigarette rods may be cut in half to acquire a pair of second cigarette rods and a filter may be attached between both second cigarette rods. Each of the front end portion and rear end portion of each of the first cigarette rods corresponds to a filter-unattaching side end portion of an associated pair of second cigarette rods.

In this case, the detection step includes detecting tobacco shred filling states of first portions of the continuous cigarette rod which correspond to the front end portions of individual first cigarette rods, and detecting tobacco shred filling states of second portions of the continuous cigarette rod which correspond to the rear end portions of individual first cigarette rods. The predetermined portions of the continuous cigarette rod include the first and second portions of the continuous cigarette rod.

The prediction step includes a determination step of, upon prediction of improper tobacco shred filling states at one of the first and second portions of the continuous cigarette rod corresponding to any one of the first cigarette rods, determining that the any first cigarette rod may suffer improper tobacco shred filling before that first cigarette rod is cut off from the continuous cigarette rod.

The elimination step includes eliminating those first cigarette rods which have been determined as having a possibility of suffering improper tobacco shred filling in the determination step after those first cigarette rods are cut off from the continuous cigarette rod.

According to this preferable mode, it is possible to separately and independently predict the proper/improper tobacco shred filling states in the first and second portions of the continuous cigarette rod which correspond to the end portions of the individual second cigarette rods on the filter-unattaching sides. That is, it is possible to predict a possibility of performing the improper tobacco shred filling at the end portions of the individual second cigarette rods on the filter-unattaching sides, which are more likely to suffer falling of tobacco shreds than the end portions of the second cigarette rods on the filter-attaching sides. Further, since any first cigarette rod which has been predicted to suffer possible improper tobacco shred filling in one of its end portions is eliminated, the control of the cigarette manufacturing process can be simplified as compared with the case where only one of two second cigarette rods included in each first cigarette rod which has been determined as suffering possible improper tobacco shred filling is eliminated.

Alternatively, the detection step includes detecting tobacco shred filling states of first consolidated portions of the continuous cigarette rod each corresponding to a front end portion of an associated one of the first cigarette rods and to a rear end portion of a preceding first cigarette rod adjacent to a front end of the associated one first cigarette rod, and detecting tobacco shred filling states of second consolidated portions of the continuous cigarette rod each corresponding to a rear end portion of an associated one of the first cigarette rods and to a front end portion of a succeeding first cigarette rod adjacent to a rear end of the associated one first cigarette rod. Each of the first and second consolidated portions of the continuous cigarette rod corresponds to a filter-unattaching side end portion of associated two second cigarette rods.

The prediction step includes a determination step of, upon prediction of improper tobacco shred filling states at the first or the second consolidated portions of the continuous cigarette rod, determining that at least one of two of the first cigarette rods associated with the determined consolidated portions may suffer improper tobacco shred filling before the associated two first cigarette rods are cut off from the continuous cigarette rod.

The elimination step includes eliminating the two first cigarette rods which have been determined as having a possibility of suffering improper tobacco shred filling in the determination step after both first cigarette rods are cut off from the continuous cigarette rod.

According to this preferable mode, it is possible to detect the tobacco shred filling states in the individual consolidated portions of the continuous cigarette rod which include the to-be-cut planes of the continuous cigarette rod (the ends of the cigarette rods on the filter-unattaching sides) in the center in the lengthwise direction. That is, it can surely detect the tobacco shred filling states in the proximity of the ends of the cigarette rods from which tobacco shreds most likely come off, so that improper filling of the tobacco shreds near the ends of the cigarette rods can de determined reliably.

According to another aspect of this invention, there is provided an apparatus for determining tobacco shred filling quality, which is used in a cigarette manufacturing apparatus having a paper wrapping section for wrapping tobacco shreds with a cigarette paper to acquire a continuous cigarette rod and a cutting section, located downstream of the paper wrapping section, for cutting the continuous cigarette rod conveyed from the paper wrapping section into cigarette rods.

The apparatus embodying this invention comprises a detector, located upstream of the cutting section to face the continuous cigarette rod conveyed from the paper wrapping section, for continuously generating a filling density signal representing a tobacco shred filling density of the continuous cigarette rod as the continuous cigarette rod is conveyed; a sampling section for successively sampling those portions of the filling density signal which correspond to predetermined portions of the continuous cigarette rod which in turn correspond to at least respective one end portions of individual cigarette rods; and a prediction section for sequentially predicting tobacco shred filling qualities at at least respective one end portions of individual cigarette rods based on the sampled portions of the filling density signal.

This apparatus of the invention has such an advantage that the tobacco shred filling states in respective one end portions or both end portions of individual cigarette rods can be precisely predicted based on the filling density signal, whereby possible falling of tobacco shreds from one or both of the ends of the cigarette rods can be accurately predicted. The detector in the apparatus of this invention may be constituted by a typical sensor used in a cigarette manufacturing apparatus to check the tobacco shred amount. The use of such a sensor both for checking the tobacco shred amount and determining the tobacco shred filling quality in this invention can contribute to reducing the cost for the apparatus of this invention.

It is preferable that the sampling section intermittently should sample the filling density signal during sampling periods respectively corresponding to the predetermined portions of the continuous cigarette rod. The prediction section includes an integration section for integrating the filling density signal intermittently sampled during each of the sampling periods and generating an integral output representing an integration result, and a determination section for predictively determining that a tobacco shred filling state in an end portion of an associated cigarette rod corresponding to the integral output is improper when the integral output lies outside an allowable range.

According to this preferable mode, the tobacco shred filling states in the end portions of individual cigarette rods can be precisely predicted based on the filling density signal continuously sent from the detector.

It is preferable that the apparatus of this invention should further comprise an elimination section, located downstream of the cutting section of the cigarette manufacturing apparatus, for eliminating any cigarette rod corresponding to that integral output which has been determined as lying outside the allowable range in the determination section.

According to this preferable mode, defects can surely be rejected.

The apparatus of the invention may be equipped in a cigarette manufacturing apparatus having means for making tobacco shred filling densities at the predetermined portions of the continuous cigarette rod higher than those at other portions of the continuous cigarette rod.

According to this preferable mode, it is possible to increase the tobacco shred filling densities in one end portions or both end portions of individual cigarette rods and to reliably predict a possibility of the falling of tobacco shreds from one or both of the ends of cigarette rods which can still occur even if such an increase is accomplished.

The apparatus of this invention may be equipped in a filter cigarette manufacturing apparatus having a filter attachment section. The filter attachment section cuts each of first cigarette rods of double unit length, cut from the continuous cigarette rod in the cutting section, into a pair of second cigarette rods, inserts a filter plug of double unit length between each pair of second cigarette rods and attaching both of the second cigarette rods to the filter plug inserted therebetween. Each of a front end portion and a rear end portion of each of the first cigarette rods corresponds to a filter-unattaching side end portion of an associated pair of second cigarette rods.

In the apparatus of this invention as equipped in such a filter cigarette manufacturing apparatus, it is preferable that the sampling section should intermittently sample the filling density signal during first sampling periods respectively corresponding to first portions of the continuous cigarette rod which correspond to the front end portions of individual first cigarette rods and during second sampling periods respectively corresponding to second portions of the continuous cigarette rod which correspond to the rear end portions of individual first cigarette rods. The predetermined portions of the continuous cigarette rod include the first and second portions of the continuous cigarette rod.

The integration section integrates the filling density signal sampled during each of the first sampling periods and generates a first integral output resulting from that integration, and integrates the filling density signal sampled during each of the second sampling periods and generates a second integral output resulting from that integration. When determining that the first integral output corresponding to each of the first cigarette rods lies outside a first allowable range or the second integral output corresponding to that first cigarette rod lies outside a second allowable range, the determination section determines that the first cigarette rod may suffer improper tobacco shred filling. The elimination section eliminates that first cigarette rod which has been determined, by the determination section, as being expected to suffer possible improper tobacco shred filling.

According to this preferable mode, it is possible to separately and independently predict the proper/improper tobacco shred filling states in the first and second portions of the continuous cigarette rod which correspond to both end portions of the individual first cigarette rods. That is, it is possible to predict improper tobacco shred filling at the end portions of the second cigarette rods on the filter-unattaching sides, which are more likely to suffer falling of tobacco shreds than the end portions of the second cigarette rods on the filter-attaching sides. Further, since any first cigarette rod which has been predicted to suffer possible improper tobacco shred filling in one of end portions is eliminated, the control of the cigarette manufacturing process can be simplified as compared with the case where only one of two second cigarette rods included in each first cigarette rod which has been determined as suffering possible improper tobacco shred filling is eliminated.

Alternatively, the sampling section intermittently samples the filling density signal during first consolidation sampling periods respectively corresponding to first consolidated portions of the continuous cigarette rod each corresponding to a front end portion of an associated one of the first cigarette rods and to a rear end portion of a preceding first cigarette rod adjacent to a front end of the associated one first cigarette rod, and during second consolidation sampling periods respectively corresponding to second consolidated portions of the continuous cigarette rod each corresponding to a rear end portion of an associated one of the first cigarette rods and to a front end portion of a succeeding first cigarette rod adjacent to a rear end of the associated one first cigarette rod. Each of the first and second consolidated portions of the continuous cigarette rod corresponds to a filter-unattaching side end portion of associated two second cigarette rods.

The integration section integrates the filling density signal sampled during each of the first consolidation sampling periods and generates a first integral output resulting from that integration, and integrates the filling density signal sampled during each of the second consolidation sampling periods and generates a second integral output resulting from that integration. When determining that the first integral output corresponding to each of the first consolidated portions of the continuous cigarette rod lies outside a first allowable range, the determination section determines that at least one of the two first cigarette rods which are associated with that first consolidated portion of the continuous cigarette rod may suffer improper tobacco shred filling. When determining that the second integral output corresponding to each of the second consolidated portions of the continuous cigarette rod lies outside a second allowable range, the determination section determines that at least one of the two first cigarette rods which are associated with that second consolidated portion of the continuous cigarette rod may suffer improper tobacco shred filling. The elimination section eliminates those two first cigarette rods which have been determined, by the determination section, as being expected to suffer possible improper tobacco shred filling.

According to this preferable mode, it is possible to surely detect the tobacco shred filling states in the proximity of the to-be-cut planes of the continuous cigarette rod or the ends of the cigarette rods from which tobacco shreds most likely come off, so that improper filling of the tobacco shreds near the ends of the cigarette rods can de determined reliably.

BRIEF DESCRIPTION OF THE DRAWINGS

FIG. 3 is a timing chart illustrating the relationship among a continuous cigarette rod conveying position, various timing signals, a filling density signal, and the like;

DETAILED DESCRIPTION OF THE PREFERRED EMBODIMENT

Figure 1:
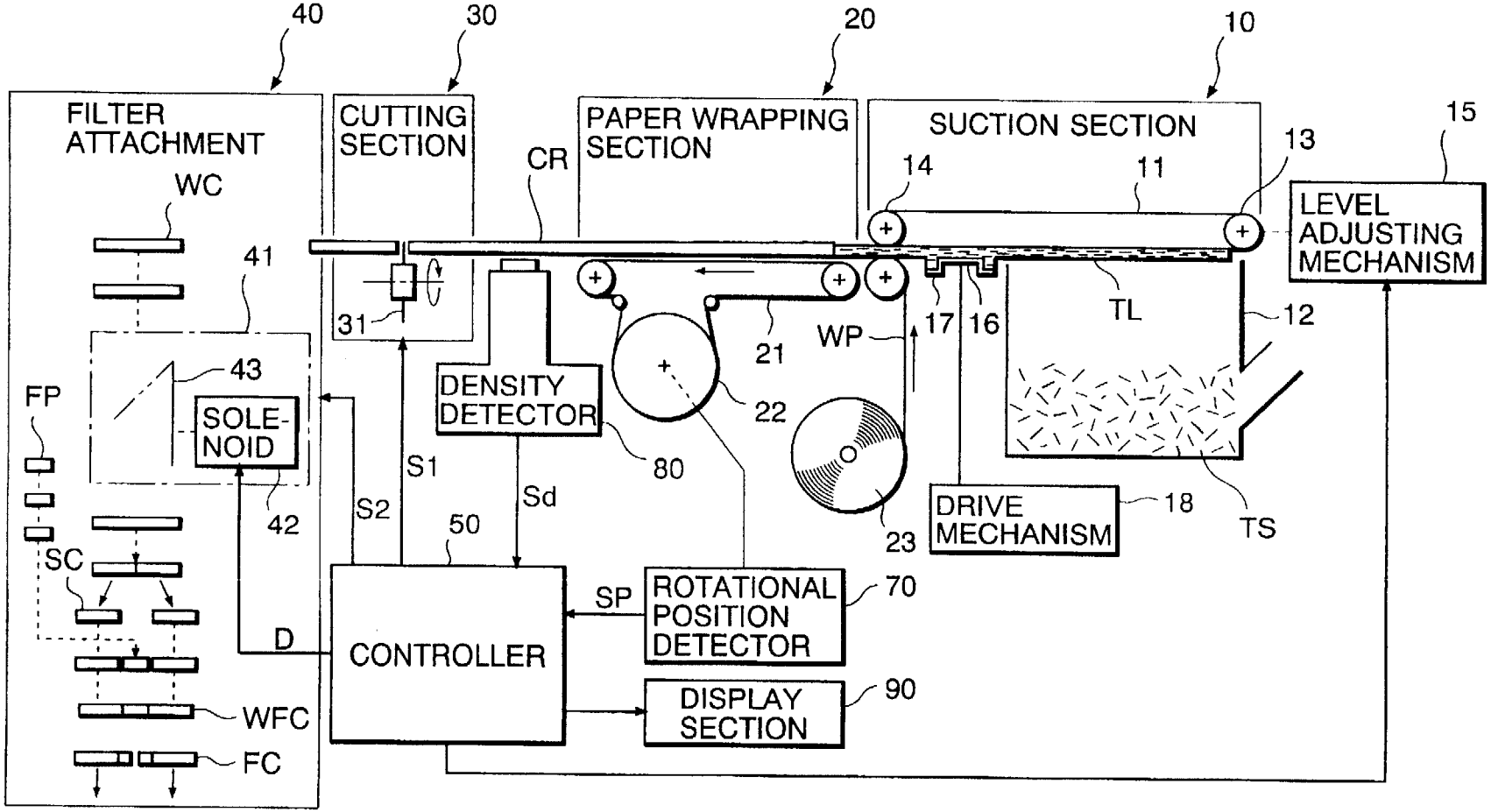
FIG. 1 is a schematic diagram illustrating a cigarette manufacturing apparatus.

Referring to FIG. 1, a filter cigarette manufacturing apparatus includes a suction section 10 having an endless suction belt (tobacco band) 11. As the suction belt 11 of the suction section 10 runs, tobacco shreds TS supplied in a hopper 12 are conveyed to a paper wrapping section 20 while being adsorbed in layer to the suction belt 11. The suction belt 11 and its drive roller 13 and guide roller 14 are supported by a level adjusting mechanism 15 so that their heights can be adjusted. The level adjusting mechanism 15 adjusts the interval between the suction belt 11 and a pair of trimming disks located below the belt 11 to adjust the thickness of a tobacco shred layer TL. Both trimming disks 16 are arranged side by side across the suction belt 11 in such a manner that their outer peripheral portions overlap each other on the inner side in the radial direction of the disks 16.

The paper wrapping section 20 has an endless garniture tape 21 and a driving drum 22 for running this tape 21. An elongated wrapping paper WP supplied to the paper wrapping section 20 from a paper roll 23 travels as the garniture tape 21 runs. The paper wrapping section 20 continuously wraps the tobacco shreds, supplied from the suction section 10, with the wrapping paper while feeding the wrapping paper to form a continuous cigarette rod CR. This continuous cigarette rod is cut to double cigarette rods (first cigarette rods) WC of a predetermined length, e.g., a double unit length by a blade 31 of a cutting section 30 provided downstream of the paper wrapping section 20.

Each of the double cigarette rods WC supplied from the cutting section 30 is cut into a pair of single cigarette rods (second cigarette rods) at a filter attachment 40 located downstream of the cutting section 30. Each pair of single cigarette rods SC are moved away from each other, and a filter plug FP of double unit length is inserted between the opposing faces of those single cigarette rods. Further, each pair of single cigarette rods SC and the filter plug FP inserted therebetween are connected by a tipping paper (not shown), yielding a double filter cigarette rod WFC. This rod WFC is cut in half at the center of the filter plug FP, thus yielding filter cigarette rods FC.

To prevent tobacco shreds from falling from the ends of the cigarette rods, the tobacco shred filling density at predetermined portions of the continuous cigarette rod (hatched portions of the continuous cigarette rod in FIG. 3) which correspond to both end portions of each single cigarette rod SC is made higher than that of the remaining portion of the continuous cigarette rod. To increase the filling density, pockets 17 are formed at the outer peripheral portions of the pair of trimming disks 16 with some interval (corresponding to the length of a single cigarette rod FC) in the circumferential direction. That is, the filling density in the predetermined portions of the continuous cigarette rod is increased by the capacity of this pocket 17.

Even if the filling density in the predetermined portions of the continuous cigarette rod is increased, tobacco shreds may fall from the ends of the cigarette rods when some shock is applied to the cigarette rods at the time of cutting the continuous cigarette rod or the like.

The cigarette manufacturing apparatus shown in FIG. 1 is equipped with a tobacco shred filling quality determining apparatus, which determines the tobacco shred filling quality of a continuous cigarette rod and eliminates any double cigarette rod WC which may suffer improper filling based on the determination result.

Figure 2:
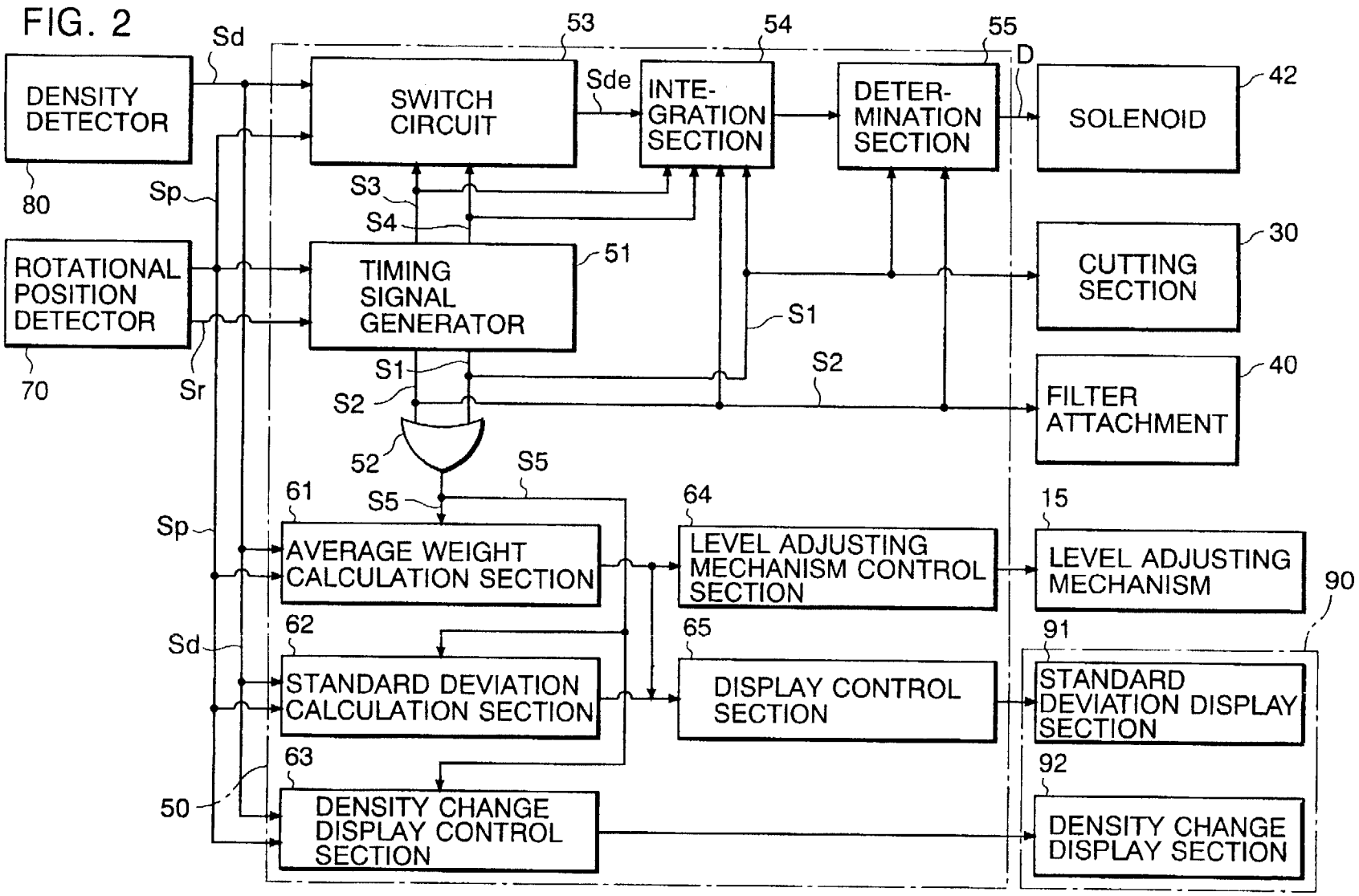
FIG. 2 is a schematic block diagram showing an apparatus for determining the tobacco shred filling quality of cigarette rods according to one embodiment of this invention.

The filling quality determining apparatus according to one embodiment of this invention comprises a controller 50, which includes various functional sections illustrated in FIG. 2, a rotational position detector 70, which is comprised of, for example, an encoder or a proximity sensor to detect the rotational position of the driving drum 22, and a density detector 80 for continuously detecting the tobacco shred filling density of a continuous cigarette rod.

The rotational position detector 70 generates a reference pulse signal Sr when the driving drum reaches a specific rotational position, and generates a pulse signal Sp every time the driving drum 22 turns by a predetermined angle. The reference pulse signal Sr is generated once during one turn of the driving drum 22. The pulse signal Sp is generated at time intervals which are determined by the length of the double cigarette rod WC and the rotational speed of the driving drum 22 (the running speed of the garniture tape). For example, 1,200 pulse signals Sp are output while the driving drum 22 makes one turn (while the continuous cigarette rod is conveyed by a distance equal to the total length of, for example, four double cigarette rods WC).

The density detector 80, which is comprised of, for example, an ultraviolet ray density sensor, is located downstream of the paper wrapping section 20 and upstream of the cutting section 30, facing the path for conveying cigarette rods CR. This density detector 80 continuously detects the tobacco shred filling density of the continuous cigarette rod which passes nearby from the peripheral surface side of the continuous cigarette rod, and outputs a density signal Sd representing the detected filling density.

The controller 50 has components 51 to 55 shown in FIG. 2, and performs a function of determining the tobacco shred filling quality. The controller 50 also has a general function of controlling the operations of the various sections 10, 20, 30 and 40 of the cigarette manufacturing apparatus in synchronism with the rotation of the driving drum 22 of the paper wrapping section 20 in association with the production of filter cigarette rods. Since the latter control function is well known, its explanation will partially be omitted in the following description.

As shown in FIG. 2, the controller 50 includes a timing signal generator 51 connected to the rotational position detector 70. The timing signal generator 51 generates a reference timing signal, for example, when the driving drum 22 reaches a specific rotational position for the first time after the cigarette manufacturing apparatus enters the steady operational state, i.e., when the reference pulse signal Sr is output for the first time from the rotational position detector 70. The timing signal generator 51 includes a counter for counting the number of pulse signals Sp supplied from the rotational position detector 70, and generates timing signals S1 to S4 at predetermined timings.

Specifically, the timing signal generator 51 generates the continuous-cigarette-rod cut timing signal (hereinafter called first timing signal) S1 representing the timing for cutting the continuous cigarette rod CR into double cigarette rods WC every time it receives, for example, 300 (corresponding to the length of each double cigarette rod) pulse signals Sp after the generation of the reference timing signal. Further, the timing signal generator 51 generates the double-cigarette-rod cut timing signal (hereinafter called second timing signal) S2 representing the timing for cutting each double cigarette rod WC into single cigarette rods SC when it receives 150 (corresponding to the length of each single cigarette rod) pulse signals Sp after the generation of each first timing signal S1. Furthermore, the timing signal generator 51 generates the timing signal S3 representing the beginning of the rear end portion of each double cigarette rod (hereinafter called third timing signal) upon reception of 280 pulse signals Sp after the generation of each first timing signal S1. The timing signal generator 51 also generates the timing signal S4 representing the end of the front end portion of each double cigarette rod (hereinafter called fourth timing signal) upon reception of 20 pulse signals Sp after the generation of each first timing signal S1.

The first timing signal S1 is supplied to the cutting section 30 from the timing signal generator 51 with a desired delay time which is determined mainly by the distance between the density detector 80 and the blade 31 and the speed of conveying the continuous cigarette rod (the delay circuit is not illustrated). In the cutting section 30, the blade 31 cuts the continuous cigarette rod CR into double cigarette rods WC in accordance with the delayed supply of the first timing signal S1.

The second timing signal S2 is supplied to the filter attachment 40 from the timing signal generator 51 with a desired delay time (the delay circuit is not illustrated). In the filter attachment 40, each double cigarette rod WC is cut into single cigarette rods SC in accordance with the delayed supply of the second timing signal S2.

The controller 50 includes an OR gate 52, which receives the first and second timing signals S1 and S2 and generates the logical sum output of both signals. That is, the OR gate 52 outputs a timing signal S5 corresponding to both ends of each single cigarette rod (hereinafter called fifth timing signal).

The controller 50 includes a switch circuit 53, which receives the density signal Sd, the pulse signal Sp and the third and fourth timing signals S3 and S4. This switch circuit 53 is closed only for the duration time for the pulse signal SP during the period (sampling period) from the point of the reception of the third timing signal S3 to the point of the reception of the fourth timing signal S4, every time it receives this pulse signal Sp. Consequently, the density signal Sd is intermittently sampled in the sampling period.

An integration section 54 in the controller 50 receives the first to fourth timing signals S1–S4 and the analog output (sampled density signal Sde) of the switch circuit 53. The integration section 54 integrates the sampled density signal Sde, intermittently output from the switch circuit 53, over a period (first integration period (corresponding to 20 pulse signals Sp)) from the point of the reception of the first timing signal S1 to the point of the reception of the fourth timing signal S4. In this embodiment, the integration section 54 has a converter for performing analog-to-digital conversion of the analog output of the switch circuit 53 to acquire the value of the sampled density signal Sde, and an accumulator for sequentially adding the value of the sampled density signal Sde intermittently output from this converter. On and after the reception of each first timing signal S1, this accumulator accumulates the values of the sampled density signals Sde. When the fourth timing signal S4 following the first timing signal S1 is input to the integration section 54, the accumulated value of the sampled density signal ΣSde is stored in a memory device as an integral value (first integral value) ΣSde1 of the sampled density signals over the first integration period. The first integral value ΣSde1 represents the tobacco shred filling amount (more generally, the filling state) of a first portion CR1 of the continuous cigarette rod which corresponds to the front end portion WCF of the double cigarette rod. When the integration section 54 receives the second timing signal S2 following the fourth timing signal S4 (the point corresponding to the position where the double cigarette rod is to be cut), the accumulated value ΣSde is reset.

On and after the integration section 54 receives the third timing signal S3 following this second timing signal S2, the accumulator accumulates the sampled density signal Sde. When the integration section 54 receives the first timing signal S1 following this third timing signal S3, the accumulated value of the sampled density signals ΣSde is stored in the memory device as an integral value (second integral value ΣSde2) of the sampled density signals over a period (second integration period) from the point of the reception of the third timing signal S3 to the point of the reception of the first timing signal S1, and the accumulated value ΣSde is then reset. The second integral value ΣSde2 represents the tobacco shred filling state of a second portion CR2 of the continuous cigarette rod which corresponds to the rear end portion WCR of the double cigarette rod.

The controller 50 further includes a determination section 55 which receives the first and second timing signals S1 and S2 and the output of the integration section 54. When receiving the second timing signal S2, this determination section 55 receives the first integral value ΣSde1 output then from the integration section 54 and determines if this first integral value ΣSde1 is smaller than a first allowable lower limit (more generally, if it falls within a first allowable range). When receiving the first timing signal S1, this determination section 55 receives the integral output (second integral value) ΣSde2 then, and determines if this value is smaller than a second allowable lower limit. When determining that one or both of the first and second integral values fall below the respective allowable lower limits, the determination section 55 determines that there is a "possibility of an insufficient tobacco shred filling amount at one or both end portions of a double cigarette rod (more generally, an improper tobacco shred filling state)" and sends a defect signal D to a solenoid 42 of an elimination section 41 of the filter attachment 40 with a desired delay time (the delay circuit not shown).

When the solenoid 42 is energized by the input defect signal D, a distribution member 43 of the elimination section 41 moves to the position indicated by the two-dotted chain line in FIG. 1 from the position indicated by the solid line. Consequently, the double cigarette rod WC corresponding to the portion of the continuous cigarette rod which has been determined as defective is directed toward a defect discharge port, and is eliminated from the production line. Then, the sending of the defect signal D is stopped and the distribution member 43 returns to the position indicated by the solid line in FIG. 1.

In sampling the density signal in the above-described procedures, a determination on the tobacco shred filling quality cannot be performed for the first double cigarette rod WC produced immediately after the cigarette manufacturing apparatus reaches the steady operational state, so that this rod is removed from the production line.

Figure 4:
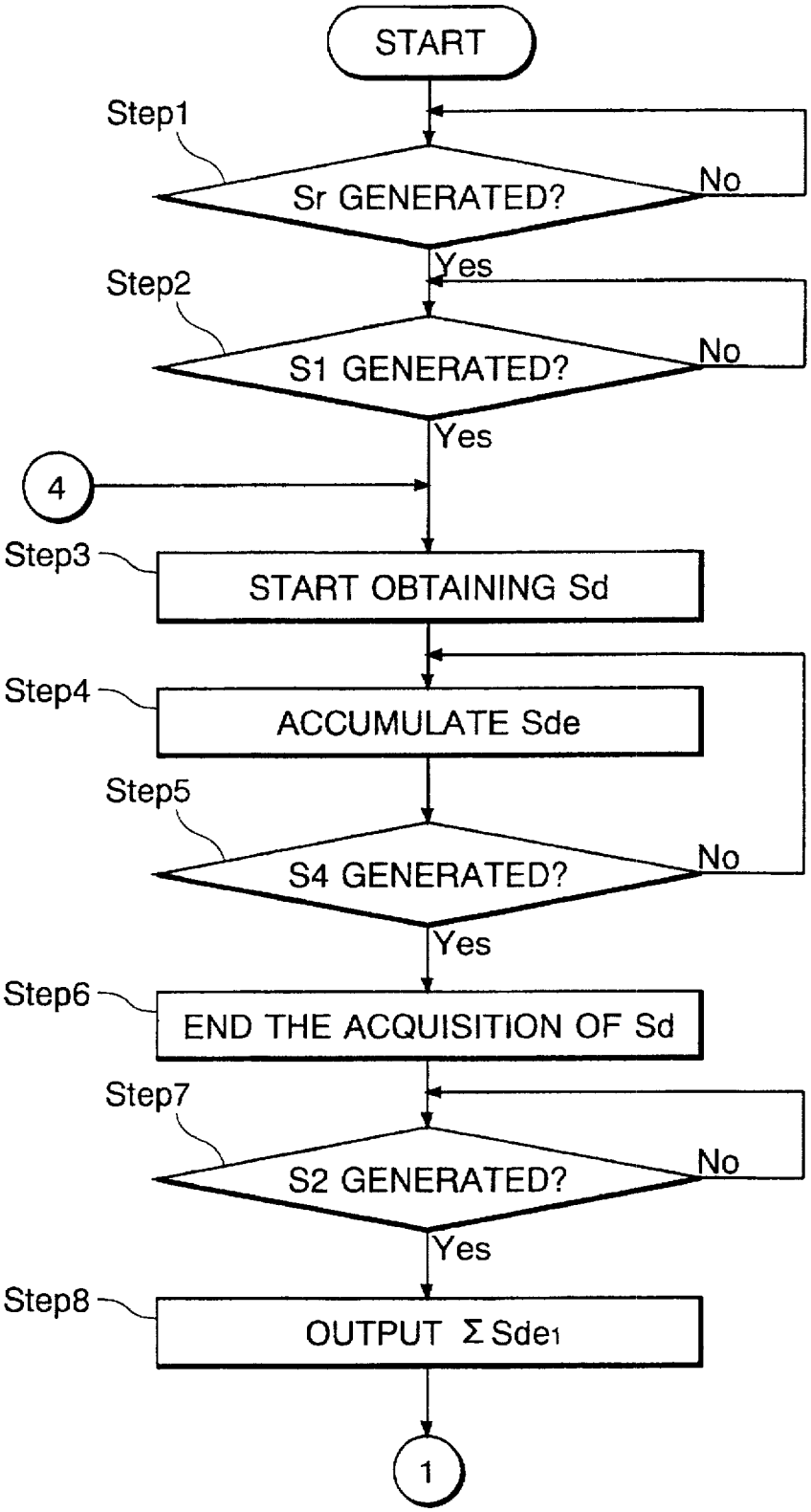
FIG. 4 is a flowchart illustrating a part of the operation of the filling quality determining apparatus shown in FIG. 2.
Figure 5:
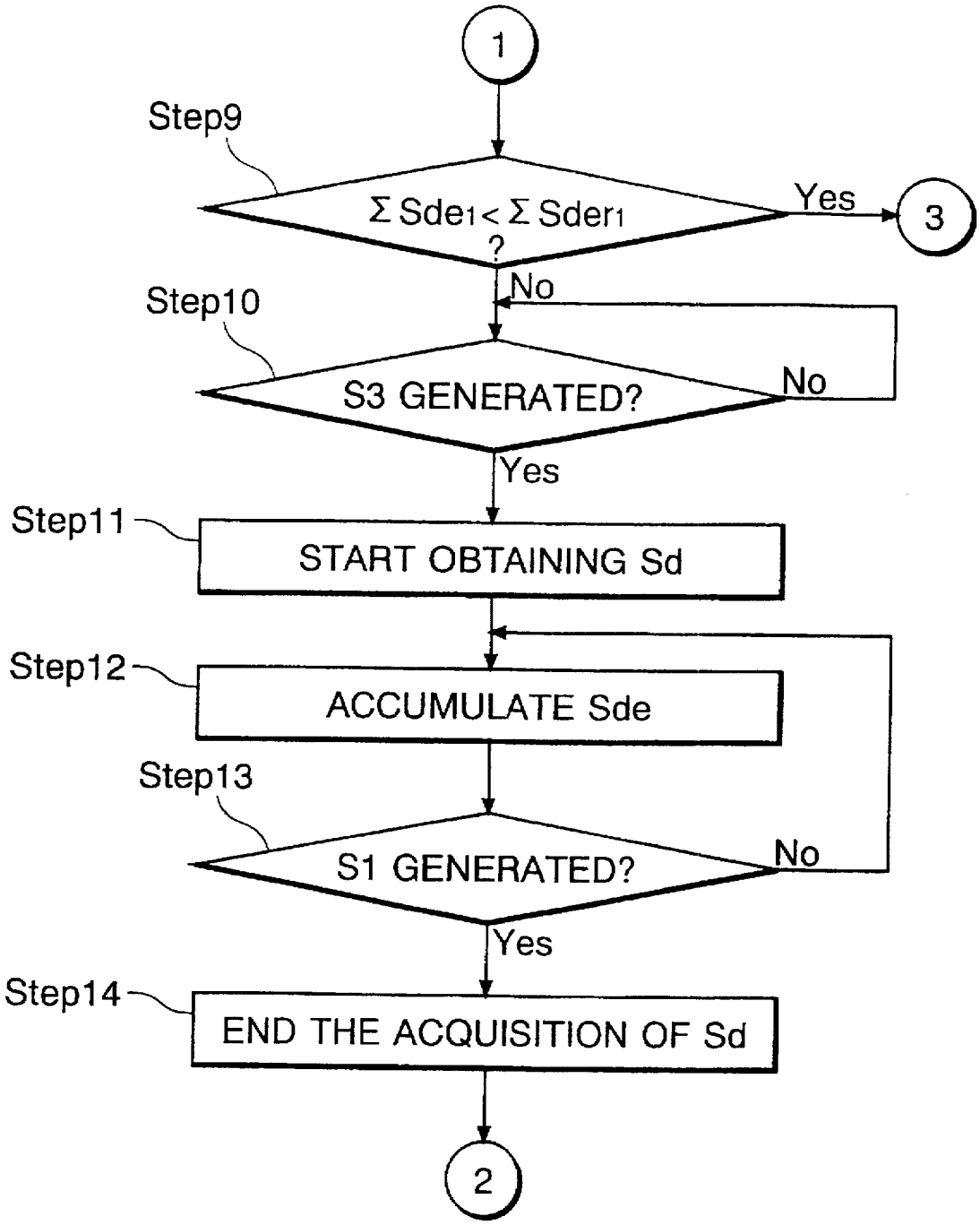
FIG. 5 is a flowchart illustrating another part of the operation of the apparatus in FIG. 2 and following the flowchart in FIG. 4.
Figure 6:
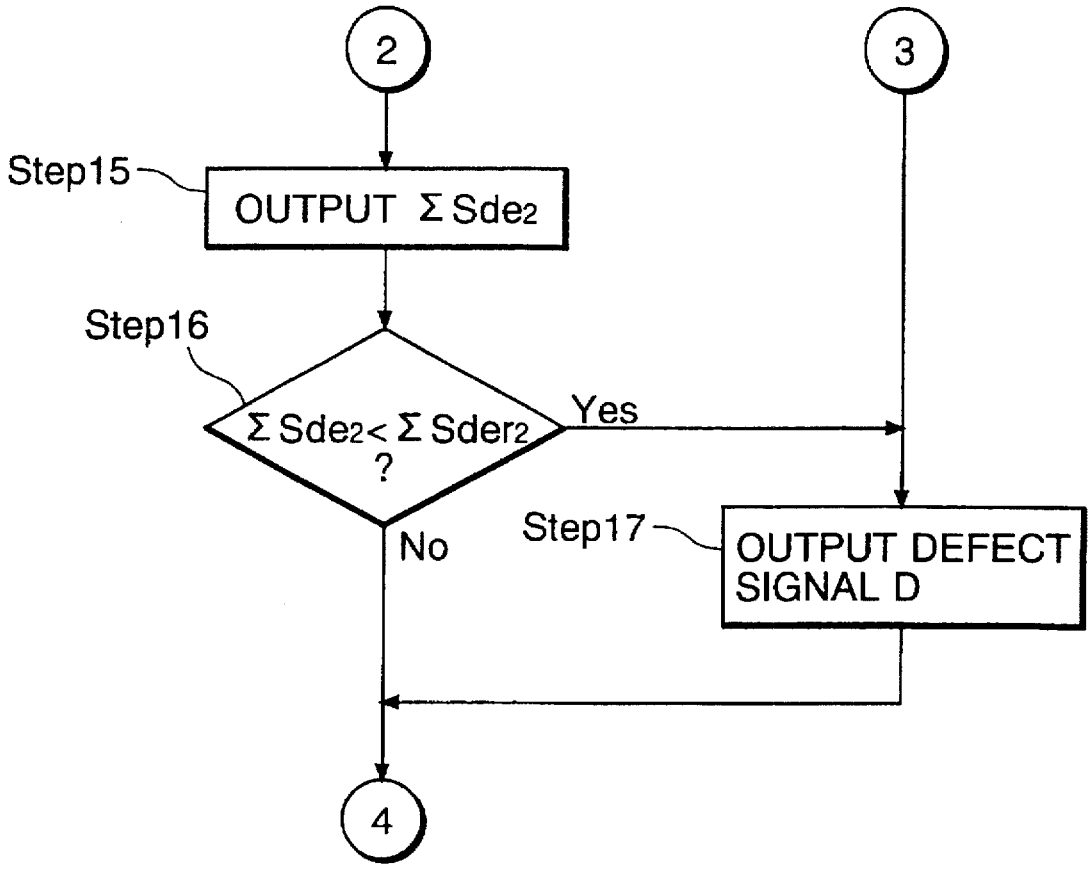
FIG. 6 is a flowchart illustrating the remaining part of the operation of the apparatus in FIG. 2 and following the flowchart in FIG. 5.

FIGS. 4 through 6 present flowcharts illustrating the operation of the tobacco shred filling quality determining apparatus when the essential portions of the components 51, 53, 54 and 55 of this apparatus are realized by a computer.

When it is determined in step 1 that the timing signal generator 51 has received the reference pulse signal Sr, a determination is made if the timing signal generator 51 has generated the first timing signal S1 (step 2). When the generation of the first timing signal S1 is determined, the acquisition of the density signal Sd starts (step 3), causing the switch circuit 53 to start sending the sampled density signal Sde to the integration section 54. The sampled density signals Sde which are output one after another are accumulated by the accumulator in the integration section 54 (step 4). When the generation of the fourth timing signal S4 is determined in step 5, the acquisition of the density signal Sd ends (step 6). The first integral value ΣSde1 is acquired by accumulating the sampled density signals Sde over a density signal acquisition period (first integration period) which started in step 3 and has ended in step 6. Thereafter, when the generation of the second timing signal S2 is determined in step 7, the first integral value ΣSde1 is sent to the determination section 55 (step 8), which in turn determines if this first integral value ΣSde1 is smaller than a first allowable lower limit ΣSder1 (step 9).

If the decision in step 9 is negative, the acquisition of the density signal Sd starts when the generation of the third timing signal S3 is determined in step 10 (step 11). Then, the sampled density signal Sde, intermittently sent to the integration section 54 from the switch circuit 53, is accumulated by the accumulator in the integration section 54 (step 12). When the generation of the first timing signal S1 is determined in step 13, the acquisition of the density signal Sd ends (step 14). The second integral value ΣSde2, which is acquired by accumulating the sampled density signals Sde over a density signal acquisition period (second integration period) which started in step 11 and has ended in step 14, is sent to the determination section 55 (step 15), which in turn determines if this second integral value ΣSde2 is smaller than a second allowable lower limit ΣSder2 (step 16). When the decision in this step is negative, the process which starts with step 3 is executed.

When it is determined in step 9 that the first integral value ΣSde1 is smaller than the first allowable lower limit ΣSder1, or it is determined in step 16 that the second integral value ΣSde2 is smaller than the second allowable lower limit ΣSder2, the determination section 55 sends out the defect signal D (step 17).

A brief description will now be given of the other functions of the controller 50 than the function for determining the tobacco shred filling quality.

The controller 50 includes an average weight calculation section 61, a standard deviation calculation section 62 and a density change display control section 63, which receive the fifth timing signal S5, the density signal Sd and the pulse signal Sp.

After receiving the fifth timing signal S5, the average weight calculation section 61 receives the density signal Sd and stores it as a density signal value upon every reception of the pulse signal Sp. The density signal values are sequentially accumulated. When receiving the next fifth timing signal S5, this calculation section 61 multiplies a value, obtained by dividing the accumulated density signal value by the number of the input pulse signals Sp, by a predetermined coefficient to acquire the average weight of that portion of the continuous cigarette rod which corresponds to the interval of the generation of the fifth timing signals S5, or the average weight of an associated single cigarette rod. The output signal of the average weight calculation section 61, which represents the average weight, is sent to a level adjusting mechanism control section 64. This control section 64 controls the level adjusting mechanism 15 in accordance with the difference between the average weight and the target value to thereby control the thickness of the tobacco shred layer TL. This control of the average weight can permit the average weight to approach the target value.

After receiving the fifth timing signal S5, the standard deviation calculation section 62 receives the density signal Sd and stores it as a density signal value upon every reception of the pulse signal Sp. When receiving the next fifth timing signal S5, this calculation section 62 acquires the standard deviation of the tobacco shred filling density of each single cigarette rod based on the currently stored density signal values. This standard deviation is displayed together with the average weight on a standard deviation display section 91 which is controlled by a standard-deviation display control section 65.

After receiving the fifth timing signal S5, the density change display control section 63 receives the density signal Sd and stores it as a density signal value upon every reception of the pulse signal Sp. When receiving the next timing signal S5, a change in the tobacco shred filling density in a single cigarette rod in the lengthwise direction thereof (dense-end state) is displayed on a density change display section 92 based on the currently stored density signal values.

The action and advantages of the above-described tobacco shred filling quality determining apparatus will further be discussed.

According to this apparatus, at the cigarette manufacturing stage before the continuous cigarette rod CR is actually cut into the double cigarette rods WC, the tobacco shred filling amounts in the first or second portions CR1 or CR2 of the continuous cigarette rod, which correspond to the front end portions WCF or the rear end portions WCR of the double cigarette rods WC, are acquired with a high precision, and it is then determined if there is an insufficient tobacco shred filling amount in each portion CR1 or CR2 of the continuous cigarette rod. This can overcome a difficulty in detecting all the improper tobacco shred filling states which vary from one to another in the case where the improper/proper tobacco shred filling state is determined from the end sides of the single cigarette rods, obtained by cutting the double cigarette rods, during the conveyance of the single cigarette rods.

With regard to that portion of the continuous cigarette rod which has been determined as having an insufficient tobacco shred filling amount, it is determined that tobacco shreds may fall from the ends of the double cigarette rods corresponding to this portion of the continuous cigarette rod in the subsequent steps of cutting the continuous cigarette rod, feeding double cigarette rods, cutting each double cigarette rod, attaching a filter chip and so forth. The defect signal D is output for any double cigarette rod which may suffer an insufficient filling amount, and this cigarette rod is removed from the production line. In this manner, those cigarette rods with insufficient tobacco shred filling amounts which may suffer the falling of tobacco shreds from one or both of the ends can reliably be eliminated as defects which do not meet a predetermined standard quality.

In the above-described apparatus of this embodiment, the density detector 80 is used both for the control of the average amount and the determination of the tobacco shred filling quality which characterizes this invention. In general, the cigarette manufacturing apparatus often executes average weight control, so that it is generally equipped with the density detector. When the filling quality determining apparatus of this invention is equipped in such a cigarette manufacturing apparatus, no special density detector should be added, thus contributing to cost reduction.

This invention is not limited to the above-described embodiment, but may be modified in various other forms.

Although the foregoing description of the embodiment has been given of the case where this invention is adapted for the production of filter cigarette rods, this invention can also be adapted to determine the proper/improper tobacco shred filling states of filterless cigarette rods.

Although the foregoing description of this embodiment has been given of the case where this invention is adapted for the production of filter cigarette rods which makes tobacco shred filling densities at predetermined portions of the continuous cigarette rod corresponding to both end portions of single cigarette rods higher than those at other portions of the continuous cigarette rod, this invention can also be adapted for use in the case where the tobacco shred filling densities only at those predetermined portions of the continuous cigarette rod which correspond to filter-unattaching ends of single cigarette rods are increased. In this case, the trimming disk pockets 17 are formed at the peripheral portions of the trimming disks 16 at the circumferential interval corresponding to length of each double cigarette rod. In the above-described embodiment and this modification, the tobacco shred filling amounts at the respective end portions of cigarette rods may be controlled to reach a target value based on the integral output of the integration section 54 which represents the tobacco shred filling amounts at the end portions of the cigarette rods. In this case, the target value may be designed variable so that the degree of an increase in the amount of the tobacco shreds at each end portion of each cigarette rod can be variably adjusted.

Although this embodiment uses a single density detector for both of the control of the average amount and the determination of the tobacco shred filling quality in this invention, a density detector may be used specifically for the determination of the tobacco shred filling quality.

According to this embodiment, those double cigarette rods which may experience falling of tobacco shreds from one ends or both ends are removed from the cigarette production line before the step of cutting the double cigarette rods. This significantly reduces the probability of causing the falling of tobacco shreds in the subsequent steps in the cigarette manufacturing process. However, there is still a possibility that such falling of tobacco shreds occurs.

In this respect, two photosensors (not illustrated) may be so arranged as to face the conveying paths for two lines of filter cigarette rods FC, at the subsequent stage of the step of cutting the filter double cigarette rods, so that those sensors detect if falling of the tobacco shreds from the ends of the cigarette rods FC occurs, from the front end side of the cigarette rods. In this case, a second elimination section separate from the elimination section 41 should be provided at the subsequent stage of the sensors, so that the second elimination section removes those cigarette rods which have been determined as suffering possible falling of tobacco shreds from the rod end based on the sensor outputs, from the production line under the control of the controller 50.

According to this modification, the elimination section 41 eliminates those double cigarette rods WC which are predicted to have improper filling, and the second elimination section eliminates those defects which are detected by the additional sensors. It is therefore possible to prevent significantly an escape of defects from occurring. This can considerably decrease the chance that cigarette rods whose tobacco shreds have fallen from the ends are mixed in those cigarette rods which are to be packed for shipment.

In this embodiment, the tobacco shred filling amount $\Sigma Sde1$ in the front end portion WCF of each double cigarette rod and the tobacco shred filling amount $\Sigma Sde2$ in the rear end portion WCR thereof are determined separately and independently. It is therefore possible to eliminate only those single cigarette rods which have been determined as having an insufficient amount of tobacco shreds filled, instead of removing double cigarette rods that include one or two single cigarette rods which have been determined as having an insufficient filling amount of tobacco shreds. In this case, if both of a pair of single cigarette rods have insufficient filling amounts of tobacco shreds, both single cigarette rods are removed.

Although this embodiment determines whether or not tobacco shred filling states at the first and second portions of the continuous cigarette rod which correspond to both end portions of a double cigarette rod (the end portions of single cigarette rods on the filter-unattaching side) are proper, a similar determination may be made on those portions of the continuous cigarette rod which correspond to both end portions of a single cigarette rod.

Figure 3:
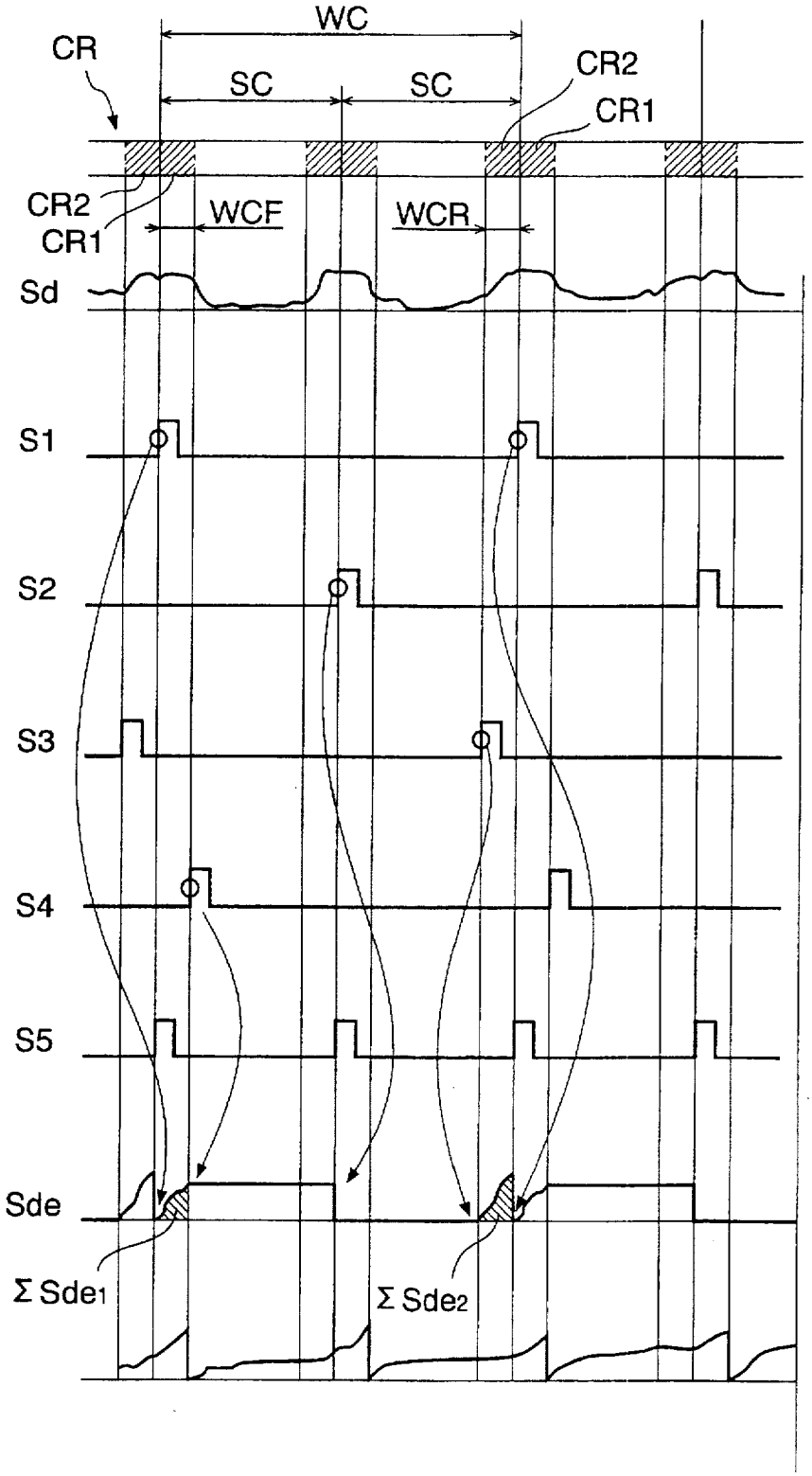

As apparent from the timing chart shown in FIG. 3 and the flowcharts illustrated in FIGS. 4 through 6, the density signal Sd is acquired in the period which corresponds to the interval from the beginning of the rear end portion of a preceding double cigarette rod to each double cigarette rod to the end of the front end portion of that each double cigarette rod (from the point of the generation of the signal S3 to the point of the generation of the signal S4) and in the period which corresponds to the interval from the beginning of the rear end portion of each double cigarette rod to the end of the front end portion of a succeeding double cigarette rod (from the point of the generation of the signal S3 to the point of the generation of the signal S4).

Instead of separating the former period into a first half period (second integration period) and a second half period (first integration period) and separating the latter period into a first half period (second integration period) and a second half period (first integration period) both in association with the integration of the sampled density signal Sde as done in the above-described embodiment, the sampled density signals Sde may be integrated over the entire former period and over the entire latter period. In this case, the properness/improperness of the tobacco shred filling state in the front end portion of each double cigarette rod and the properness/improperness of the tobacco shred filling state in the rear end portion of a preceding double cigarette rod are collectively determined based on the integral output ($\Sigma Sde2+\Sigma Sde1$) associated with the former period, and the properness/improperness of the tobacco shred filling state in the rear end portion of each double cigarette rod and the properness/improperness of the tobacco shred filling state in the front end portion of a succeeding double cigarette rod are collectively determined based on the integral output ($\Sigma Sde2+\Sigma Sde1$) associated with the latter period. When improper filling is determined in association with the former period, the two double cigarette rods associated with the former period are removed, and when improper filling is determined in association with the latter period, the two double cigarette rods associated with the latter period are removed.

Figure 7:
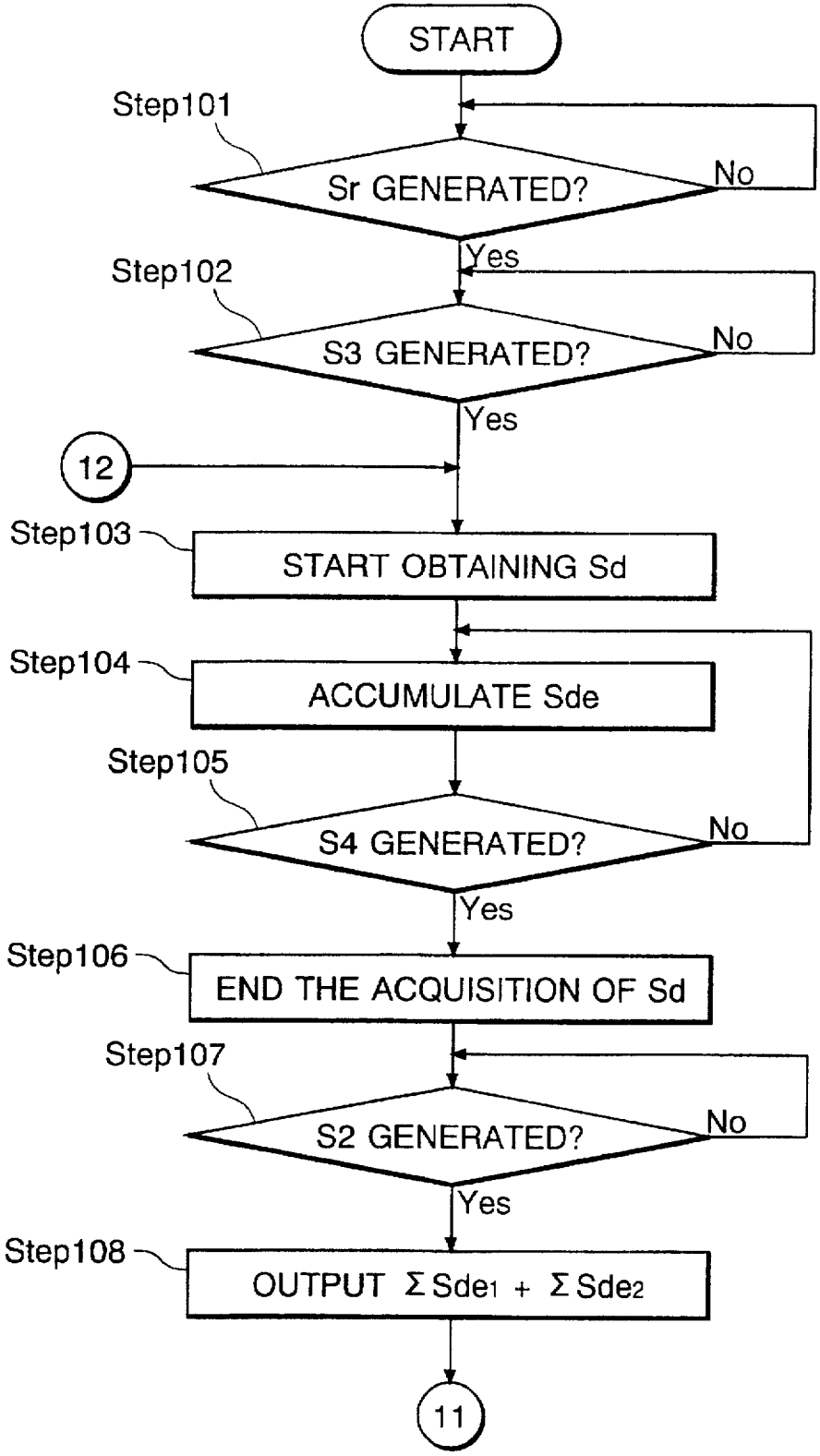
FIG. 7 is a flowchart illustrating a part of the operation of a filling quality determining apparatus according to a modification of this invention.
Figure 8:
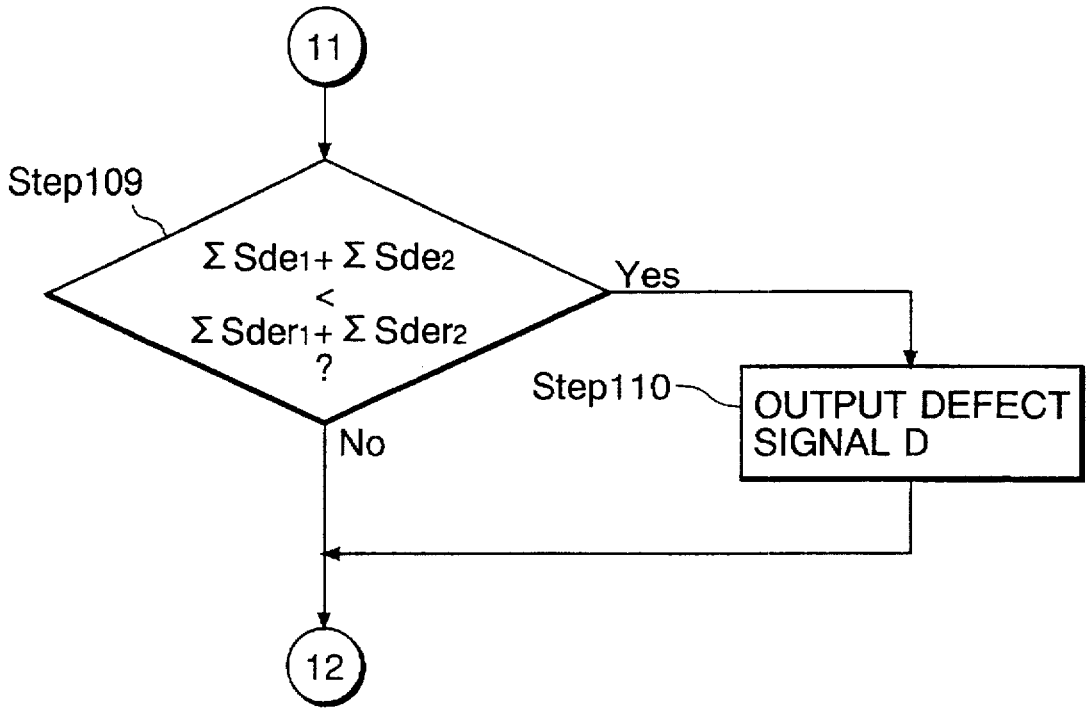
FIG. 8 is a flowchart illustrating the remaining part of the operation of the apparatus according to this modification and following the flowchart in FIG. 7.

This modification can be accomplished by the apparatuses shown in FIGS. 1 and 2. The operational flow of this modification is illustrated in FIGS. 7 and 8. Steps 101 to 108 in FIG. 7 correspond to steps 1 to 8 in FIG. 4. The generation of the first timing signal S1 is determined in step 2, whereas it is determined in step 102 if the third timing signal S3 has been generated. While the integral output ΣSde1 is output in step 8, the integral output (ΣSde1+ΣSde2) is output in step 108. While the integral output ΣSde1 is compared with the allowable lower limit ΣSder1 in step 16 in FIG. 6, the integral output (ΣSde1+ΣSde2) is compared with the allowable lower limit (ΣSder1+ΣSder2) in step 108 in FIG. 8. Step 110 corresponds to step 17 in FIG. 6.

Although the accumulator for obtaining the first integral value ΣSde1 representing the filling state in the first portion CR1 of the continuous cigarette rod is reset at the time of generating the second timing signal S2 representing the timing for cutting the double cigarette rod which includes the portion CR1 in the above-described embodiment, it may be reset when the first integral value ΣSde1 is acquired (when the fourth timing signal S4 representing the end of the portion CR1 of the continuous cigarette rod is generated). The above-described modification may likewise be modified.

Although the thickness of the tobacco shred layer TL is adjusted by the level adjusting mechanism 15 in this embodiment, the height of the trimming disks 16 may be adjusted to control the layer thickness.

Although the tobacco shred filling states in the entire end portions of double cigarette rods are collectively determined in the above-described embodiment, each rod end portion may be separated into two or more segments, allowable ranges may be provided for the respective segments and the tobacco shred filling state in each segment may be determined.

It should be apparent to those skilled in the art that the present invention may be embodied in many other specific forms without departing from the spirit or scope of the invention.

What is claimed is:

1. A method of determining the tobacco shred filling quality of cigarette rods acquired by cutting a continuous cigarette rod obtained by wrapping tobacco shreds with a cigarette paper, comprising:

a detection step of sequentially detecting tobacco shred filling states in those predetermined portions of the continuous cigarette rod which correspond to at least respective one end portions of individual cigarette rods before cutting the continuous cigarette rod; and a prediction step of sequentially predicting tobacco shred filling qualities at at least respective one end portions of individual cigarette rods, based on said sequentially detected tobacco shred filling states, before the continuous cigarette rod is cut into the individual cigarette rods.

2. The method according to claim 1, further comprising an elimination step of eliminating those cigarette rods whose tobacco shred filling states have been predicted as improper in said prediction step after those cigarette rods are cut off from the continuous cigarette rod.

3. The method according to claim 1, wherein said method is adapted for cigarette production which makes tobacco shred filling densities at predetermined portions of the continuous cigarette rod higher than those at other portions of the continuous cigarette rod.

4. The method according to claim 1, wherein said method is adapted for production of filter cigarettes, which sequentially cuts the continuous cigarette rod into first cigarette rods of double unit length, then cutting each of said first cigarette rods in half to acquire a pair of second cigarette rods and attaching a filter between both second cigarette rods, each of a front end portion and a rear end portion of each of said first cigarette rods corresponding to a filter-unattaching side end portion of an associated pair of second cigarette rods;

said detection step includes detecting tobacco shred filling states of first portions of the continuous cigarette rod which correspond to said front end portions of individual first cigarette rods, and includes detecting tobacco shred filling states of second portions of the continuous cigarette rod which correspond to said rear end portions of individual first cigarette rods, said predetermined portions of the continuous cigarette rod including said first and second portions of the continuous cigarette rod;

said prediction step includes a determination step of, upon prediction of improper tobacco shred filling states at one of said first and second portions of the continuous cigarette rod corresponding to any one of said first cigarette rods, determining that said any first cigarette rod may suffer improper tobacco shred filling before that first cigarette rod is cut off from the continuous cigarette rod; and said elimination step eliminates those first cigarette rods which have been determined as having a possibility of suffering improper tobacco shred filling in said determination step after those first cigarette rods are cut off from the continuous cigarette rod.

5. The method according to claim 1, wherein said method is adapted for production of filter cigarettes, in which the continuous cigarette rod is sequentially cut into first cigarette rods of double unit length, then each of said first cigarette rods is cut in half to acquire a pair of second cigarette rods and a filter is attached between both second cigarette rods, each of a front end portion and a rear end portion of each of said first cigarette rods corresponding to a filter-unattaching side end portion of an associated pair of second cigarette rods;

said detection step includes detecting tobacco shred filling states of first consolidated portions of the continuous cigarette rod each corresponding to a front end portion of an associated one of said first cigarette rods and to a rear end portion of a preceding first cigarette rod adjacent to a front end of said associated one first cigarette rod, and includes detecting tobacco shred filling states of second consolidated portions of the continuous cigarette rod each corresponding to a rear end portion of an associated one of said first cigarette rods and to a front end portion of a succeeding first cigarette rod adjacent to a rear end of said associated one first cigarette rod, each of said first and second consolidated portions of the continuous cigarette rod corresponding to a filter-unattaching side end portion of associated two second cigarette rods;

said prediction step includes a determination step of, upon prediction of improper tobacco shred filling states at said first or said second consolidated portions of the continuous cigarette rod, determining that at least one of two of said first cigarette rods associated with said determined consolidated portions may suffer improper tobacco shred filling before said associated two first cigarette rods are cut off from the continuous cigarette rod; and said elimination step includes eliminating said two first cigarette rods which have been determined as having a possibility of suffering improper tobacco shred filling in said determination step after both first cigarette rods are cut off from the continuous cigarette rod.

6. An apparatus for determining tobacco shred filling quality, which is used in a cigarette manufacturing apparatus having a paper wrapping section for wrapping tobacco shreds with a cigarette paper to acquire a continuous cigarette rod and a cutting section, located downstream of said paper wrapping section, for cutting the continuous cigarette rod conveyed from said paper wrapping section into cigarette rods, said apparatus comprising:

a detector, located upstream of said cutting section to face the continuous cigarette rod conveyed from said paper wrapping section, for continuously generating a filling density signal representing a tobacco shred filling density of the continuous cigarette rod as the continuous cigarette rod is conveyed;

a sampling section for successively sampling those portions of said filling density signal which correspond to predetermined portions of the continuous cigarette rod which in turn correspond to at least respective one end portions of individual cigarette rods; and a prediction section for sequentially predicting tobacco shred filling qualities at at least respective one end portions of individual cigarette rods based on said sampled portions of said filling density signal.

7. The apparatus according to claim 6, wherein said sampling section intermittently samples said filling density signal during sampling periods respectively corresponding to said predetermined portions of the continuous cigarette rod; and said prediction section includes an integration section for integrating said filling density signal intermittently sampled during each of said sampling periods and generating an integral output representing an integration result, and a determination section for predictively determining that a tobacco shred filling state in an end portion of an associated cigarette rod corresponding to said integral output is improper when said integral output lies outside an allowable range.

8. The apparatus according to claim 7, further comprising an elimination section, located downstream of said cutting section of said cigarette manufacturing apparatus, for eliminating any cigarette rod corresponding to that integral output which has been determined as lying outside said allowable range in said determination section.

9. The apparatus according to claim 8, wherein said apparatus is equipped in a filter cigarette manufacturing apparatus having a filter attachment section; and said filter attachment section cuts each of first cigarette rods of double unit length, cut from the continuous cigarette rod in said cutting section, into a pair of second cigarette rods, inserts a filter plug of double unit length between each pair of second cigarette rods and attaching both of said second cigarette rods to said filter plug inserted therebetween, each of a front end portion and a rear end portion of each of said first cigarette rods corresponding to a filter-unattaching side end portion of an associated pair of second cigarette rods.

10. The apparatus according to claim 9, wherein said sampling section intermittently samples said filling density signal during first sampling periods respectively corresponding to first portions of the continuous cigarette rod which correspond to said front end portions of individual first cigarette rods and during second sampling periods respectively corresponding to second portions of the continuous cigarette rod which correspond to said rear end portions of individual first cigarette rods, said predetermined portions of the continuous cigarette rod including said first and second portions of the continuous cigarette rod;

said integration section integrates said filling density signal sampled during each of said first sampling periods and generates a first integral output resulting from that integration, and integrates said filling density signal sampled during each of said second sampling periods and generates a second integral output resulting from that integration;

when determining that said first integral output corresponding to each of said first cigarette rods lies outside a first allowable range or said second integral output corresponding to that first cigarette rod lies outside a second allowable range, said determination section determines that said first cigarette rod may suffer improper tobacco shred filling; and said elimination section eliminates that first cigarette rod which has been determined, by the determination section, as being expected to suffer possible improper tobacco shred filling.

11. The apparatus according to claim 9, wherein said sampling section intermittently samples said filling density signal during first consolidation sampling periods respectively corresponding to first consolidated portions of the continuous cigarette rod each corresponding to a front end portion of an associated one of said first cigarette rods and to a rear end portion of a preceding first cigarette rod adjacent to a front end of said associated one first cigarette rod, and during second consolidation sampling periods respectively corresponding to second consolidated portions of the continuous cigarette rod each corresponding to a rear end portion of an associated one of said first cigarette rods and to a front end portion of a succeeding first cigarette rod adjacent to a rear end of said associated one first cigarette rod, each of said first and second consolidated portions of the continuous cigarette rod corresponding to a filter-unattaching side end portion of associated two second cigarette rods;

said integration section integrates said filling density signal sampled during each of said first consolidation sampling periods and generates a first integral output resulting from that integration, and integrates said filling density signal sampled during each of said second consolidation sampling periods and generates a second integral output resulting from that integration;

when determining that said first integral output corresponding to each of said first consolidated portions of the continuous cigarette rod lies outside a first allowable range, said determination section determines that at least one of two of said first cigarette rods which are associated with that first consolidated portion of the continuous cigarette rod may suffer improper tobacco shred filling, and when determining that said second integral output corresponding to each of said second consolidated portions of the continuous cigarette rod lies outside a second allowable range, said determination section determines that at least one of said two first cigarette rods which are associated with that second consolidated portion of the continuous cigarette rod may suffer improper tobacco shred filling; and said elimination section eliminates those two first cigarette rods which have been determined, by the determination section, as being expected to suffer possible improper tobacco shred filling.

12. The apparatus according to claim 6, wherein said apparatus is equipped in a cigarette manufacturing apparatus having means for making tobacco shred filling densities at predetermined portions of the continuous cigarette rod higher than those at other portions of the continuous cigarette rod.

* * * * *